US006899075B2

(12) United States Patent
Saint-Hilaire et al.

(10) Patent No.: US 6,899,075 B2
(45) Date of Patent: May 31, 2005

(54) QUASITURBINE (QURBINE) ROTOR WITH CENTRAL ANNULAR SUPPORT AND VENTILATION

(76) Inventors: Roxan Saint-Hilaire, Casier 2804-3535 Ave. Papineau, Montreal (CA), H2K4J9; Ylian Saint-Hilaire, Casier 2804-3535 Ave. Papineau, Montreal (CA), H2K4J9; Gilles Saint-Hilaire, Casier 2804-3535 Ave. Papineau, Montreal (CA), H2K4J9; Françoise Saint-Hilaire, Casier 2804-3535 Ave. Papineau, Montreal (CA), H2K4J9

( * ) Notice: Subject to any disclaimer, the term of this patent is extended or adjusted under 35 U.S.C. 154(b) by 0 days.

(21) Appl. No.: 10/367,032

(22) Filed: Feb. 19, 2003

(65) Prior Publication Data

US 2004/0079321 A1 Apr. 29, 2004

Related U.S. Application Data

(60) Provisional application No. 60/366,298, filed on Mar. 22, 2002.

(51) Int. Cl.[7] ..... F02B 53/00; F01C 1/44

(52) U.S. Cl. ..... 123/241; 418/270; 475/226; 475/227

(58) Field of Search ..... 123/241; 418/270; 475/227, 226, 333; F01C 1/44; F02B 53/00

(56) References Cited

U.S. PATENT DOCUMENTS

| | | | | | |
|---|---|---|---|---|---|
| 716,970 | A | * | 12/1902 | Werner | 418/270 |
| 1,164,769 | A | * | 12/1915 | Walter | 475/227 |
| 3,196,854 | A | * | 7/1965 | Novak | 418/270 |
| 3,369,529 | A | * | 2/1968 | Jordan | 418/270 |
| 3,387,596 | A | * | 6/1968 | Niemand | 123/241 |
| 4,890,511 | A | * | 1/1990 | Pedersen | 475/227 |
| 4,916,978 | A | * | 4/1990 | Razelli et al. | 475/226 |
| 6,164,263 | A | | 12/2000 | Saint-Hilaire et al. | 123/241 |
| 2002/0189578 | A1 | * | 12/2002 | Szorenyi | 123/241 |
| 2003/0062020 | A1 | * | 4/2003 | Okulov | 123/241 |

FOREIGN PATENT DOCUMENTS

| | | | | |
|---|---|---|---|---|
| FR | 2 493 397 A1 | * | 5/1982 | F02B/53/00 |
| WO | WO 8600370 A1 | * | 1/1986 | F01C/1/44 |
| WO | WO 0190536 A1 | * | 11/2001 | F01C/1/44 |

* cited by examiner

*Primary Examiner*—Thai-Ba Trieu

(57) ABSTRACT

The Quasiturbine (Qurbine in short) uses a rotor arrangement peripherally supported by four rolling carriages, the carriages taking the pivoting blade pressure-load of the blades forming the rotor, and transferring the load to the opposite internal contoured housing wall. The present invention discloses a central, annular, rotor support for the rotor geometry defined by the pivoting blades and associated wheel-bearings, while still maintaining the important center-free engine characteristic. The pressure-load on each pivoting blade is taken by its own set of wheel-bearings rolling on annular tracks attached to the central area of the lateral side covers forming part of the stator casing. This central, annular, rotor support could generally apply to all the family of Quasiturbine rotor arrangements and particularly to the limit case here considered, where the previous carriage design is replaced by a cylindrical pivoting blade joint as presented in the present patent, and for which an efficient solution of the five bodies rotary engine sealing problem is given.

27 Claims, 3 Drawing Sheets

QUASITURBINE (QURBINE) ROTOR WITH CENTRAL ANNULAR SUPPORT AND VENTILATION

This application claims benefit of U.S. Provisional Application No. 60/366,298, filed on Mar. 22, 2002.

FIELD OF THE INVENTION

This invention relates generally to a perfectly balanced, zero vibration, rotary device, and specifically to rotary engines, compressors, and pressure or vacuum pumps.

DESCRIPTION OF THE RELATED ART

The patent U.S. Pat. No. 6,164,263 discloses a general rotary device called the Quasiturbine (Qurbine in short), which uses four pivoting blades and four rolling carriages to make a rotor of variable diamond-shaped geometry, the rotor mounted within a internal contoured housing wall formed along a Saint-Hilaire confinement profile shaped somewhat like a skating rink, the sides of the internal contoured housing wall closed by lateral side covers. That Quasiturbine device uses four peripheral rolling carriages to hold the rotor in place within the internal contoured housing wall and to transfer the pivoting blade radial load-pressure to the opposite part of the internal contoured housing wall, in such a manner as to remove all load pressure from the center, making the Quasiturbine a center-free engine. U.S. Pat. No. 6,164,263 also discloses an effective but simple rotor-to-shaft differential linking mechanism and further provides a general method for the precise calculation of the Saint-Hilaire confinement profile family of curves for the internal contoured housing wall. In most rotary engines, the sealing at the pivot connection or apex between two adjacent blades must be done simultaneously with the internal contoured housing wall and also with the two lateral side covers which is a critical and difficult five-bodies sealing problem. This sealing problem was satisfactorily solved in patent U.S. Pat. No. 6,164,263 through a male-female pivot design overlapped by the carriage. Results of theoretical simulation and some experimental data revealed exceptional engine characteristics for the Quasiturbine device, and in particular the possibility of a shorter pressure pulse with a linear ramp compression-pressure raising-falling slope near top dead center.

In the present context, this invention is not an improvement of the Quasiturbine device in U.S. Pat. No. 6,164,263, but instead discloses a "central, annular, rotor support" applicable to all the family of Quasiturbine rotor arrangements for similar or other applications, where pivoting blades, wheel-bearings, and annular tracks are located within the rotor, while maintaining a center-free engine characteristic for direct power takeoff. To illustrate the central, annular, rotor support, an embodiment of the Quasiturbine has been used which employs a rotor made up of four blades incorporating simple cylindrical pivoting joints between adjacent blades without rolling carriages. The pivoting joint includes an underneath holding finger at the male end, and efficiently solves the five bodies sealing problem. The device of the present invention includes wheel-bearings and lateral side covers carrying the annular tracks to take the pressure-load applied by the blades. The invention also provides a precise parametric calculation method and criteria for unique selection of the appropriate Saint-Hilaire confinement profile so as to satisfy the optimum engine efficiency of the PV (Pressure-Volume) diagram; and this geometry permits the Quasiturbine to be scaled-up to provide power in excess of 100 MW and more. This new rotor arrangement further allows the insertion of annular power sleeves each linking each pair of two opposite blades with or without clutch centrifuge weights, on the external surface of the sleeves. A Modulated Inner Rotor Volume (MIRV) allows pumping-ventilating action and is particularly useful to cool the 90 interior of the rotor in an internal combustion engine mode. The MIRV is also generally applicable to the Quasiturbine design disclosed in patent U.S. Pat. No. 6,164,263. Finally, on the interior wall of the annular power sleeve, differential washers make a tangential linking with the power disk and shaft. Due to a shorter confinement time and a faster linear ramp compression-pressure raising-falling slope, a new combined Otto and Diesel QTIC-cycle mode is made possible, and is photo-detonation compatible.

The following rotary engine prior arts, either ignored the need or fail to provide the necessary strong mechanism needed to withstand the radial high pressure load on the rotor, fail to include a differential compensation device to smooth out the power shaft RPM from the strong rotational harmonics generated by the rotor components variable angular speeds, and none consider the most important engine efficiency criteria for rejection or selection of the internal contoured housing wall among multiple geometric possibilities, which render most of those concepts impracticable as such. Finally, none achieved the most useful empty center engine characteristics: Okulov (Pub Number US 2003/0062020 A1) discloses a balanced rotary internal combustion engine or cycling volume machine. Szorenyi (Pub Number U.S. 2002/0189578 A1) discloses a hinged rotor internal combustion engine. Niemand (U.S. Pat. No. 3,387,596) discloses a combustion engine with revolution pistons. Jordan (U.S. Pat. No. 3,369,529) discloses a rotary internal combustion engine. Novak (U.S. Pat. No. 3,196,854) discloses a rotary engine. Werner et al. (U.S. Pat. No. 1,164,769) disclose a differential gearing for motor vehicles. Razelli et al. (U.S. Pat. No. 4,916,978) disclose a differential device of the limited slip type. Pedersen (U.S. Pat. No. 4,890,511) discloses a friction reduction in a differential assembly. Contiero (Patent Number WO 86/00370 A1) discloses a cyclic volume machine.

Beaudoin (Patent Number WO 01/90536 A1) discloses a poly-induction energy turbine without back draught. Ambert (Patent Number FR 2 493 397 A) discloses a rotary vane internal combustion engine having prismatic chamber of specified shape containing rotary shaft with articulated vanes.

OBJECTS AND SUMMARY OF THE INVENTION

The object of this invention is to provide a Quasiturbine central, annular, rotor support using pivoting blades, wheel-bearings, and lateral side covers carrying annular tracks (or alternatively the canceling out of the pressure-load in the fluid energy converter mode through the annular power sleeves) generally applicable to all the family of Quasiturbine rotor arrangements and other rotary engines, compressors or pumps, and particularly to an embodiment of the Quasiturbine which employs four blades incorporating simple cylindrical pivoting joints between adjacent blades without carriages, all this while maintaining a large empty area in the center of the engine for direct power takeoff and preserving most previously claimed Quasiturbine characteristics.

Another object of this invention is to provide a "Saint-Hilaire confinement profile calculation method" of the internal contoured housing wall appropriate to the chosen Quasiturbine design arrangement, minimizing the surface to volume ratio in the compression chambers and reducing the flow turbulence. This calculation method includes criteria for engine optimum confinement profile selection from the family of curves to generate the internal contoured housing wall.

A further object of this invention is to provide a low friction, pivoting blade, joint design which is particularly suitable for non-metallic material like plastic, ceramic or glass, the joint allowing for maximum air-tightness; space for gate-type, near zero in-groove movement with single or multiple contour seals; higher maximum RPM; and suitable for very high-pressure applications with the seals designed accordingly. A compression ratio tuner can replace the sparkplug in high compression ratio photo-detonation combustion engine mode.

Another further object of this invention is to provide a Modulated Inner Rotor Volume (MIRV) producing annular pumping-ventilating action between the inner surfaces of the moving pivoting blades and the outer surfaces of the annular power sleeves, with or without clutch centrifuge weights. The Modulated Inner Rotor Volume (MIRV) is particularly useful to cool the interior of the rotor in an internal combustion engine mode, while allowing for the insertion of the differential washers on the inner surface of the annular power sleeves, making a tangential linking with the power disk and shaft.

Yet another further object of this invention is to provide a new combined Otto and Diesel Quasiturbine operation in an Internal Combustion QTIC-cycle mode, this due to the possible shorter confinement time and the faster linear ramp compression-pressure raising-falling slope, which is photo detonation compatible.

In order to achieve these objects, the Quasiturbine rotor arrangement makes use of an appropriate internal contoured housing wall calculated to receive the present, pivoting blades, rotor geometry, with a set of contour and lateral seals (linear gate type and pellets) engineered for the selected rotor arrangement.

BRIEF DESCRIPTION OF THE DRAWINGS

A more complete appreciation of the invention will be readily apparent when considered in reference to the accompanying drawings wherein.

DETAILED DESCRIPTION OF THE PREFERRED EMBODIMENT

The U.S. Pat. No. 6,164,263 patent disclosed a Quasiturbine rotor arrangement using four rolling carriages to take the pivoting blade pressure-load and transfer it to the opposite internal contoured housing wall. The present invention discloses a Quasiturbine rotor arrangement without carriages, where the pressure-load on each pivoting blade is taken by its own set of wheel-bearings located in a power transfer slot in the inner side of blade, the wheel-bearings rolling on annular tracks, one track attached to the central area of each lateral side cover. This rotor supporting configuration can apply to all the Quasiturbine family of designs, and is here illustrated on a specific Quasiturbine embodiment without rolling carriages. This Quasiturbine rotor arrangement reduces the number of components, reduces the friction surface, reduces the total wall surface in the compression chambers, and is particularly suitable for non-metallic pivoting blades, the blades being made instead from material such as plastic, ceramic or glass. Furthermore, this rotor arrangement allows for single or multiple contour seals with a near zero in-groove movement, and eliminates the need of a cooling system for carriages. This invention applies generally to rotary engines, compressors, or pressured or vacuum pumps.

Figure 1:
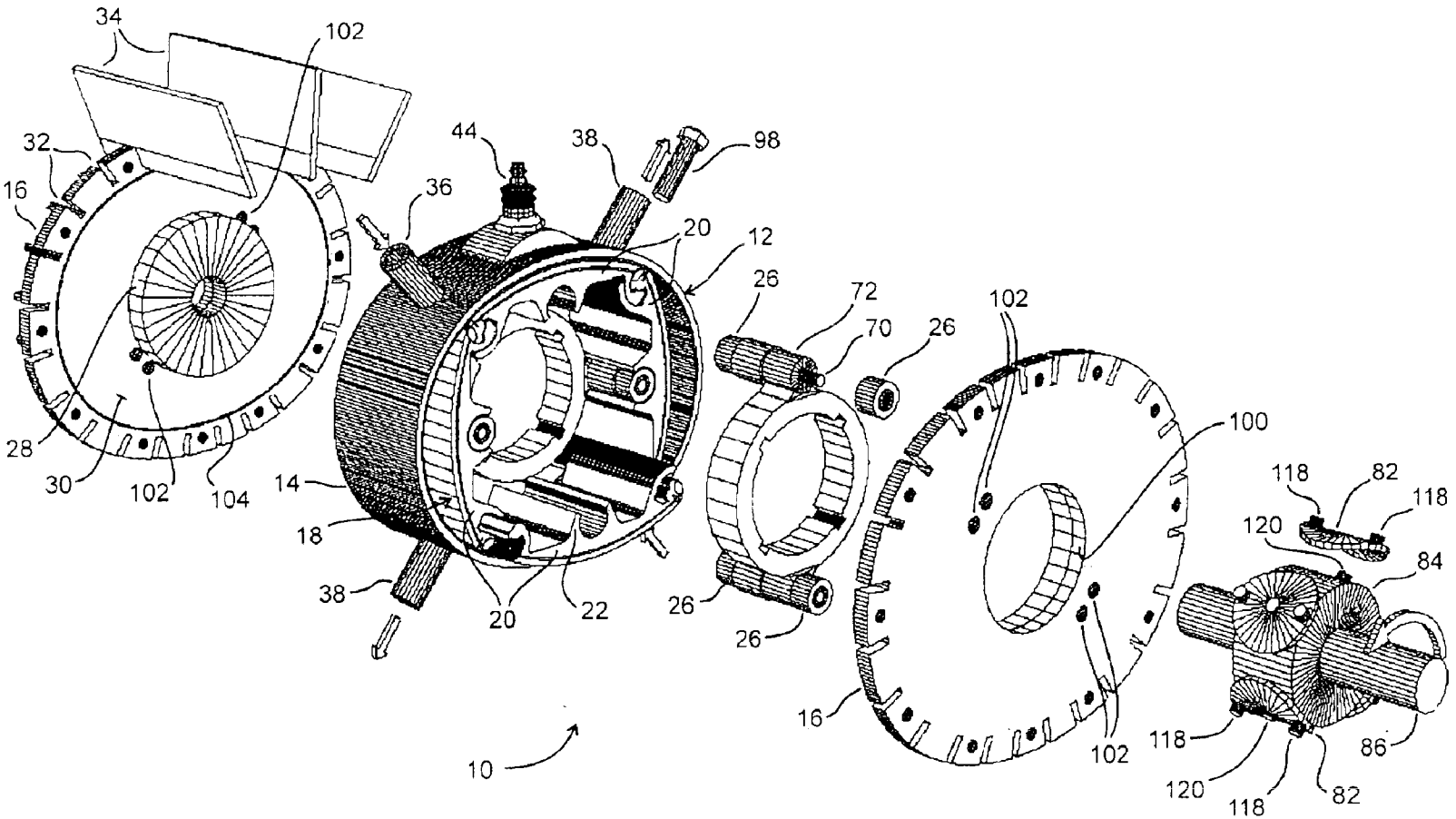
FIG. 1 is a perspective exploded view of the Quasiturbine device with an internal contoured housing wall and the four interconnected pivoting blades shown in a square configuration. Ports positioning are for fluid flow mode.

The present Quasiturbine invention is generally referred on FIG. 1 as number 10, and comprises a stator casing 12 made of a internal contoured housing wall 14 and two lateral side covers 16, one on each side of the internal contoured housing wall 14, and a rotor 18 of four or more pivoting blades 20 confined within this casing. Each pivoting blade 20 carries a power transfer slot 22 on its inner surface 24 in which wheel-bearings 26 are located. The lateral side covers 16 each have an annular track 28, not necessarily circular, on their inner surface 30 to support the wheel-bearings 26 carried by the pivoting blades 20, the wheel-bearings rolling on the tracks. Multiple notches 32 are provided on the external perimeter of the covers 16 where cooling fins 34 can be inserted. Liquid cooling is also easily feasible. Radial intake 36 and exhaust 38 ports are located in the internal contoured housing wall 14, or axial ports 126, 128, 130, 132 in the lateral side covers 16. In combustion mode, the alternate lateral sparkplug or compression ratio tuner is screw in port 128, which position can be moved angularly to permit proper timing. Intake and exhaust ports may have different angular locations for different applications as seen by comparing positioning of FIG. 1 and FIG. 2. A check-valve port 40 can be located through each pivoting blade 20 to benefit from the centrifuge intake pressure. A compression ratio tuner 42 can replace the sparkplug 44 at high compression ratio photo-detonation mode.

Figure 2:
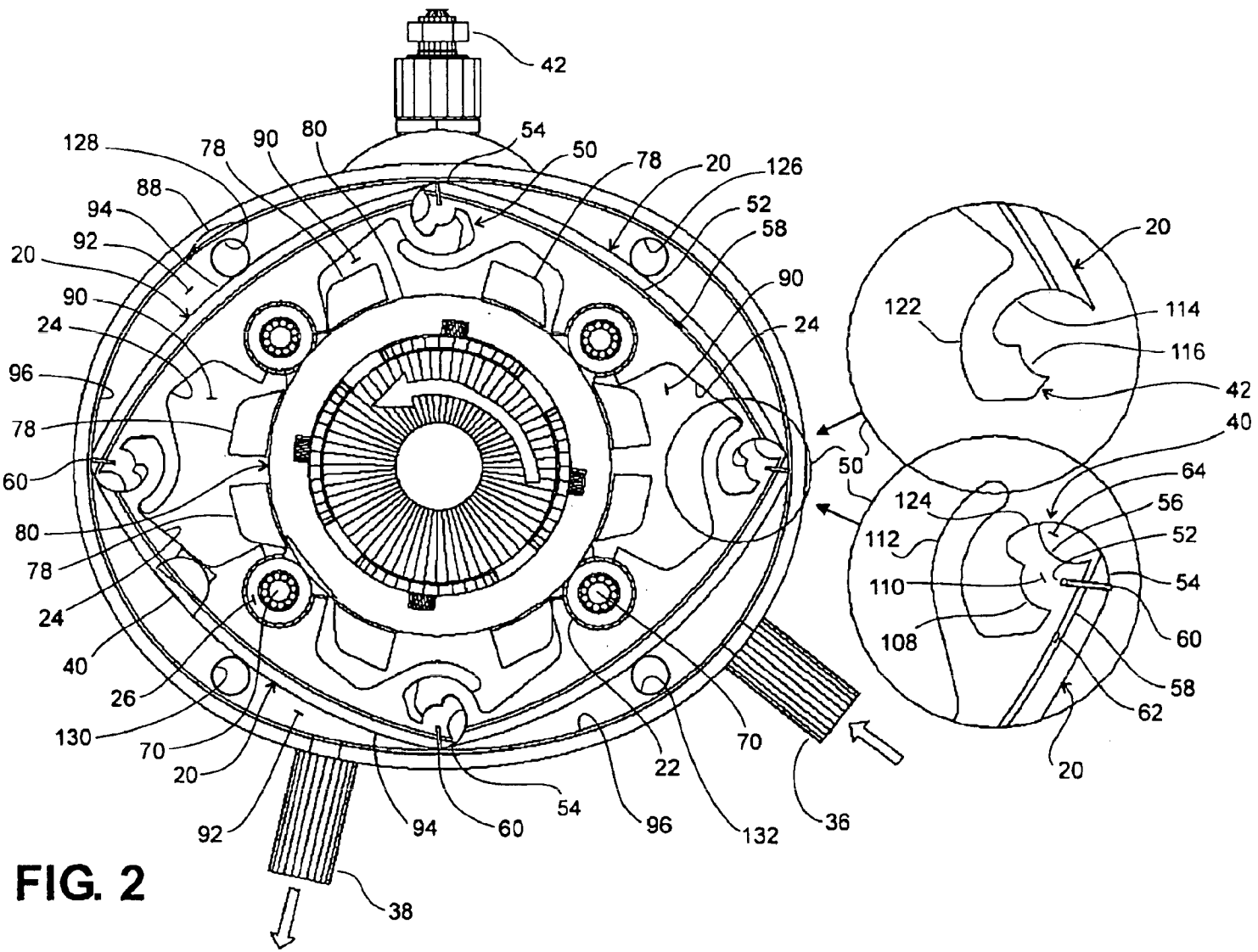
FIG. 2 is a top view with the lateral side covers removed, the four interconnected pivoting blades shown in a diamond configuration. Ports positioning are for internal combustion mode. Alternate lateral side cover port positions for fluid flow mode are also shown.

One end of each pivoting blade 20 carries a male connector 46 and the other end carries a complementary female connector 48, the male and female connectors of adjacent blades connected to provide a low friction pivot joint 50 as shown in FIG. 2. The cylindrical male connector 46 carries a contour seal groove 52 and has a rounded outer portion that acts as a guiding-rubbing pad 54 with the internal contoured housing wall 14, with provision for a hard metal or ceramic insert in that guiding-rubbing area. The pivoting blades 20 also have a lateral pellet hole 56 in the male connector 46 at the joints 50, and lateral seal grooves 58 along their sides extending between the connectors 46 48. The set of seals used in the pivoting blades is made up of contour seals 60; linear or slightly curved gate-type lateral seal 62 (which can be made continuous when located in a groove within the lateral side covers 16), and small pellet seals 64 in the male connector 46 at the pivoting blade joint 50. All the seals have a back spring, and in addition the contour seal 60 sits on a contour seal damper made of a rubber band lying in the bottom of its groove to help extend the seal life from hammering against the internal contoured housing wall.

Figure 3:
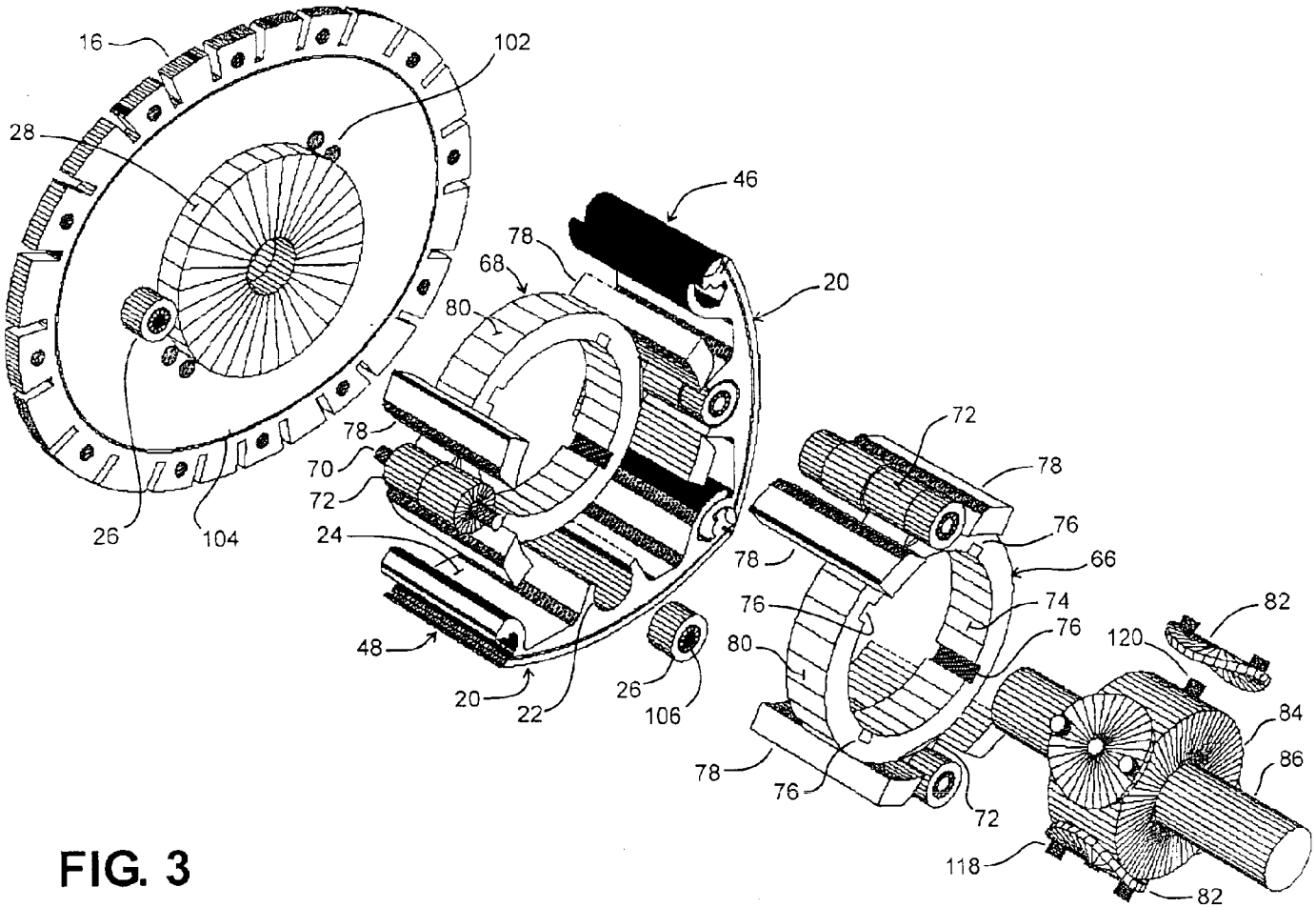
FIG. 3 is a detail perspective exploded view of the Quasiturbine showing interior details, where the internal contoured housing wall and two of the pivoting blades have been removed for better viewing.

Two annular power sleeves 66, 68 are provided, as shown in FIG. 3, each linked to the axels 70 of the wheel-bearings 26 in two opposed pivoting blade power transfer slots 22 by opposed rings 72 on each sleeve. The sleeves 66, 68 leave a large circular hole in the engine center for the shaft power disk, a direct power takeoff or other uses. The annular power sleeves 66, 68 can carry their own set of lateral side cover seals (not shown) to insulate their inward central area from their outward area. Furthermore, the inner surface 74 of the annular power sleeves 66, 68 carries several grooves 76 from which any mechanism enclosed by the sleeves can be driven. Clutch centrifuge weights 78 are located between the inner surface 24 of the pivoting blades 20 and the outer surface 80 of the annular power sleeves 66, 68, a clutch centrifuge weight 78 located adjacent each side of each of the power transfer slots 22. A tangential linking on the inner surface 74 of the annular power sleeves 66, 68 is made of several (from two to twelve or more) differential washers 82 linking the annular power sleeves 66, 68 to the central power disk 84 and the shaft 86. A calculation method for the stator casing Saint-Hilaire confinement profile of the internal contoured housing wall 14 is disclosed for the chosen Quasiturbine rotor arrangement, with a set of optimum engine internal contoured housing wall 14 selection criteria FIG. 1 shows the four interconnected pivoting blades 20 in a square configuration within the internal contoured housing wall 14, guided by the solid guiding-rubbing pads 54 provided by the male connectors 46 at the joints 50 between adjacent blades. The wheel-bearings 26 of the blades 20 roll on the annular tracks 28 carried by the lateral side covers 16. The port locations 36, 38 shown are the ones used when the Quasiturbine is operated as a fluid energy converter or compressor. The spark plug 44 is positioned as for the internal combustion mode. For clarity, the clutch centrifuge weights 78 are not shown on FIG. 1.

FIG. 2 shows the four interconnected pivoting blades 20 in a diamond configuration. FIG. 2 also shows details of the interconnecting pivot joint 50 including details of the male 46 and female 48 connectors; the contour 60 and lateral arched seals 62 and pellet seal 64; the wheel-bearings 26 and annular track 28 positioning; and the guiding-rubbing action of the pad 54 in the cylindrical male joints 50. The compression ratio tuner 42, the flame transfer slot-cavity 88 and one of the pivoting blade check valve ports 40 with the central area are shown. The port locations 36, 38 shown in FIG. 2 are the ones used when the Quasiturbine is operated in an internal combustion engine mode with counterclockwise direction of rotation. FIG. 2 also shows the Modulated Inner Rotor Volumes (MIRV) 90. Annular pumping action is provided by the varying size of the volumes 90, each located in between the inner surface 24 of the pivoting blades 20 and the outer surface 80 of the annular power sleeves 66, 68. It will be seen that the clutch centrifuge weights 78 are located within the volumes 90 and move along the outer surface 80 of the power sleeves 66, 68.

FIG. 3 shows details of the Quasiturbine with the internal contoured housing wall 14 and two of the pivoting blades 20 removed. It also shows details of the clutch centrifuge weights 78, which weights could possibly pivot around the closest wheel-bearings, the annular power sleeves 66, 68 and the differential washers 82 making a tangential linking with the power disk 84 and shaft 86.

The four pivoting blades 20 are attached to one another as a chain in forming the rotor 18 and show a variable diamond-shaped geometry while moving in a Saint-Hilaire-like confinement profile of the internal contoured housing wall 14 calculated to confine the rotor 18 at all angles of rotation. Contour seals 60 between the pivoting blades 20 and the internal contoured housing wall 14 are located at each pivot joint 50. The expansion or combustion chamber 92 is defined by the volume in-between the outer surface 94 of a pivoting blade 20 and the inner surface 96 of the internal contoured housing wall 14 and extends from one pivot joint contour seal 60 to the next. Referring to FIG. 2, as the rotor 18 turns, it does make minimum combustion chamber 92 volumes at the top and bottom (TDC), and maximum volumes at left and right (BTC). During one rotation, each pivoting blade 20 goes through four complete engine strokes, so that a total of sixteen strokes are completed in every rotation. Furthermore, as an expansion stroke starts from a horizontal pivoting blade 20 and ends when it gets vertical, the next following pivoting blade 20 is immediately starting a new expansion cycle without any dead time, which means that the Quasiturbine is a quasi-continuous flow engine at intake and exhaust, both of which can be located either radially in the internal contoured housing wall 14 or axially in the lateral side covers 16. Several removable intake and exhaust plugs 98 may be used to convert the two parallel compression and expansion circuits into a sole serial circuit. The two quasi-independent circuits are used in parallel with all plugs removed, for operation as a two stroke internal combustion engine, fluid energy converter, compressor, vacuum pump and flow meter. The two quasi-independent circuits are used in serial by plugging intermediate ports, to make a four stroke internal combustion engine as shown in the port arrangement of FIG. 2. Notice that the intake and exhaust ports have different locations for different applications and their position can be time advanced or delayed for exhaust and intake as shown in FIG. 2. The load-pressure force exercised by the compressed fluids on each pivoting blade 20 is taken by the wheel-bearings 26 rolling on the annular tracks 28 attached to their respective lateral side covers 16. With this geometrical arrangement, even with heavy pressure-loads on the pivoting blades 20, the diamond-shaped deformation of the rotor 18 requires only very little energy, and the rubbing pads 54 located in the vicinity of the pivot joints 50 and contour seals 60 guide the rotor 18 during its diamond-shaped deformation. During rotation, the wheel-bearings axels 70 are not moving at a constant angular velocity and for this reason, a differential linkage must be built within the annular power sleeves 66, 68 to drive the power disk 84 and shaft 86 at constant angular velocity.

The stator casing 12 and the lateral side covers 16 are centered on the engine rotor axis. The lateral side covers 16 have annular tracks 28 receiving the wheel-bearings 26 carried by the blades 20, which tracks are not necessarily circular. FIG. 1 shows a central hole 100 in the lateral side covers 16 that can be made large enough so that the power disk 84 and the differential washers 82 can be slide in-and-out without having to dismantle the engine. A cap bearing-holder can be inserted in the large side cover hole 100. Intake and exhaust ports 36, 38 are located either radially in the stator casing 12 or axially (not shown) in the lateral side covers 16. For the Modulated Inner Rotor Volume (MIRV) 90, the lateral, side covers 16 carry a set of ventilation ports 102 for cooling the rotor 18. A sparkplug 44 can be located at a variable angle on the top of the stator casing 12, and also at bottom (not shown) in the two stroke engine mode, and replaced, when in a very high compression ratio photo-detonation mode by a small threaded piston called a "compression ratio tuner" 42, which can be feedback controlled to optimize combustion chamber conditions for different fuels or running operation. The surface of contact between the stator casing 12 and the lateral side covers 16 carry a fix gasket 104.

The annular tracks 28 are circular only if the wheel-bearings 26 are on the line joining the axis of two successive blade pivots. The central opening in the rotor 18 could be made smaller or larger by moving the wheel-bearings 26 towards or away of the outer surface 94 of the pivoting blades 20, out of alignment with pivot joints 50, but then the annular track 28 in the side covers 16 will no longer be a perfect circle, but be elliptical-like in shape. The wheel-bearings 26 are located on each side of the pivoting blade 20 and carry roller or needle bearings 106. The blade rubbing pads 54, located in the vicinity of the contour seals 60, can be formed by the pivoting blade male connector 46 itself, or it can be formed by a little insert (not shown) containing the contour seal 60 so as to prevent the hardening of the whole pivoting blade 20. In this arrangement, hard inserts can, alternatively, be used to make the complete pivoting blade joint 50. Pressure in the combustion chamber 92 does not generate a significant torque around the wheel-bearings axles 70 carried by the pivoting blades 20 and consequently the combustion chamber pressure has little effect on the rubbing pad 54 pressure against the internal contoured housing wall 14. The rubbing pad pressure is essentially due to the small rotor deformation, which is quite independent of the pressure-load. However, this same pressure-load gives a great tangential rotational force on the whole rotor. The combustion chamber 92 can be enlarged by cutting the pivoting blade 20 and the very high compression ratio photo-detonation mode makes use of a "compression ratio tuner" 42 instead of a sparkplug 44. The manufacturing method allows for the entire stator casing and rotor to be made out of a cylindrical disk, the internal contoured housing wall being formed in the interior of the disk and the pivoting blades being formed in the outer periphery. Alternatively, the internal contoured housing wall 14 can be shaped by precision forging and the pivoting blades 20 can be metal cast or metal powder pressed. Similar techniques and molds will also work for plastic or ceramic.

The pivoting blades 20 can be made all alike with a male connector 46 and a female connector 48 to form the pivot joints 50. Alternatively, half the blades 20 can have two female connectors and the other half two male connectors. A good "five-bodies" sealed joint design is quite important and must satisfy an extensive force vector analysis. The blade pivot joint 50 of the present invention must be strong enough to take some load-pressure and all the tangential push-and-pull forces of the torque, while allowing independent low-friction rotational movement of the two connected pivoting blades 20. Simultaneously, the joint must be leak proof within itself, the internal contoured housing wall 14 and with the two lateral side covers 16. This pivot joint 50 has space, if needed, to enclose a bearing to further reduce the required rotor energy deformation. Extensive research has led to a double chisel joint pivot concept detailed on FIG. 2, where the male connector 46 has two different contact surfaces 124, 108 of corresponding radii on its main body 110 and a finger 112 spaced from the main body 110 for use in holding the pivoting blades together. The female connector 48 has also two different surfaces 114, 116 of corresponding radii located on an extending arm 122, the radii surface 114, 116 cooperating with the radii surface 124, 108 on the male connector 46 when the arm 122 is mounted between the main body 10 and the finger 112, and preventing the connectors 46, 48 from opening up. As the rotor torque increases, the joints 50 get tighter and tighter, and still more leak proof.

The contour seals 60 are single or multi-pieces drawer type seals located in the axial direction along the pivoting blade male connector 46 and have a near zero in-groove displacement, making a contact angle almost perpendicular to the internal contoured housing wall 14 at all times, departing only slightly from −6,35 to +6,35 degrees for the selected arrangement. Consecutive multiple pieces contour seals (not shown) can be used to prevent two successive chambers to be in contact with one another at the time the joint 50 passes in front of the ports 36, 38. This multi-seals configuration would also insure that at least one of the seals is at all times moving inward in its groove, while the others may be moving outward. In addition, the contour seal sits on a contour seal damper made of a rubber band lying in the bottom of its groove 52 or between the springs to help extend the seal life from hammering against the internal contoured housing wall. The pivoting blades 20 seal with the lateral side covers 16, on each side, by a linear or slightly curved gate-type lateral seal 62 and a pellet type seal 64 at the end of the male connector 46. The seal grooves are at different depth levels, so that the pressure gas behind the seals cannot propagate. A non-mandatory linear intra-pivot seal can be incorporated in the female connector 48 from one lateral side cover to the other, if required. When the pivoting blades 20 are made of smooth or fragile material like plastic, ceramic or glass, there is room for a metal insert to be placed at each pivoting blade joint 50 for proper movement and friction control. When shaped as an arc, the pivoting blade lateral seal grooves 58 are easy to make on a lathe. This arched seal, positioned near the edge of the outer surface of the pivoting blade 20 traps a minimum volume in combustion mode, and being at the far reach of the rotor, it keeps the high-pressure in the outer area of the covers 16, which reduces the total pressure-force on them. A continuous elliptical-like seal, shaped like a slightly shrunken confinement internal contoured housing wall profile, and incorporated into the lateral side covers 16 is also a simple alternative to the multi-components lateral seal set described. All seals 60, 62, 64 have a back spring to maintain them at all time respectively in contact with the internal contoured housing wall 14 and the lateral side covers 16. The low-friction wheel-bearings 26, the pivot joint 50 design, and the described seal set, allow the Quasiturbine to withstand high-pressure-load, while maintaining an excellent leak proof condition.

Many Quasiturbines may benefit in having some type of centrifuge clutches. The Quasiturbine geometry permits it to have the clutch centrifuge weights 78 within the rotor 18, each weight located between the wheel-bearings 26 and a blade end, in-between the pivoting blades 20 and the outer surface 80 of the annular power sleeves 66, 68 within the volumes 90 well ventilated by the Modulated Inner Rotor Volume (MIRV) annular central pump effect. The clutch centrifuge weights 78 can pivot around the wheel-bearings axis 70. As with any centrifuge clutches, the weights 78 will contribute slightly to increase the rotor inertia. The clutch centrifuge weights 78 can be used to drive clutch friction pads (not shown) located either on the outer surface 80 of the annular power sleeves 66, 68; or within the power disk 84 where the angular rotational speed is uniform; or externally to the Quasiturbine. Notice that with such a centrifuge clutch in place, a conventional starter must be used to drive the Quasiturbine rotor and not the power shaft 86, unless some kind of clutch-locking is provided.

Because each pair of opposed wheel-bearings 26 does not rotate at constant angular velocity, two 400 distinct but identical central annular power sleeves 66, 68 are used side-by-side along the engine axis as shown on FIG. 3, each one linking two different opposite wheel-bearings axis 70 by opposed rings 72. Each annular power sleeve 66, 68 is in the form of an annular ring with the two outer opposed rings 72 on the outer surface 80 taking the torque from the opposite pivoting blades 20 via the wheel-bearings axis 70. As an alternative of the two outer opposed mounting rings 72 on the annular power sleeves 66, 68, conventional centrifuge clutch pads (not shown) linked to the centrifuge weights 78 could be inserted between the two consecutive wheel-bearings 26 and the outer surface 80 of the annular power sleeves 66, 68. Inside the annular sleeves 66, 68 are multiple grooves 76 in the inner surface 74 in which the differential washers 82 can be attached, via washer pins 118 thereon. The differential washers 82 are rotably attached to the surface of the power disk 84 via power disk pins 120 to link the power disk 84, via an oscillating movement of the washers 82 around the power disk pins 120, to the power sleeves 66, 68. In the design shown, the maximum relative angular variation of the annular power sleeves 66, 68 is 6.35 degrees ahead and behind their respective average angular position, for a maximum differential angle of 12.7 degrees, which produces a +/−15 degrees oscillation of the differential washers 82. In the case of the pressurized fluid energy converter mode, like pneumatic or steam, where both the upper and lower chambers are symmetrically pressurized, the annular power sleeves 66, 68 can take and cancel out the mutual pressure-load of the two opposite pivoting blades 20, possibly suppressing in this case the need to use the wheel-bearings 26 and the lateral side cover annular tracks 28.

To power the shaft 86 by the two side-by-side annular power sleeves 66, 68, the shaft power disk 84 or the large diameter shaft have multiple radial extending disk pins 120 on which sits the set of differential washers 82. Each differential washer 82 has two opposite radially extending washer pins 118, each one fitting into its own internal groove 76 on power sleeve 66, 68 respectively. The thicker, or wider, that the Quasiturbine design is, the greater can be the diameter of the differential washers 82, however, fewer differential washers can be setup on the circumference of the power disk 84, except if one accepts a partial overlapping, which is well possible. Practically, the numbers of differential washers 82, the number of power disk pins 120 and the corresponding grooves 76 in the power sleeves 66, 68 can vary from two to twelve or more. In the design shown, the differential washers 82 angular oscillation around the disk pin 120 is +/−15 degrees, which requires a little play between the power disk 84 and the internal surface 74 of the annular power sleeves 66, 68 to account for the differential washer being slightly off shaft axis during oscillation. Alternatively, if the power disk 84 external surface is shaped as part of a sphere of the same diameter, the differential washer 82 can sit perfectly on it if also shaped accordingly and furthermore, since the washer pins 118 on the differential washers 82 need to be cylindrical only on a 15 degree arc, the two pins shape can be elongated toward the washer center for better strength. Each radially extending disk pin 120 can be part of the differential washer itself, and can carry a bearing. This set of differential washers 82 makes a tangential linking between the two annular power sleeves 66, 68 and the unique power disk 84, and suppresses the rotational harmonic for a constant and uniform rotational speed of the output shaft. Another differential design is presented in U.S. Pat. No. 6,164,263, and most other conventional differential designs can work, but the above described tangential linking design is more convenient because it works at a high radius, where the torque-force is minimal; it takes up little space; and it leaves a large central-free engine area for power take-off. Furthermore, it allows the large shaft diameter or the power disk-shaft 84 86 assembly to slide in-and-out of the Quasiturbine engine without it being disassembled. Like for the Quasiturbine rotor, this differential design has a fixed center of gravity during rotation and maintains the zero vibration engine characteristics. The power disk can hold a conventional feed-through shaft, or can carry, or be part of, a very large diameter thin wall tube shaft. This tube shaft may enclose a propeller screw for a water jet or pumping, or an electrical generator or else. It can also carry an axial thrust bearing at least at one end, and an engine crank starting device at either ends.

Each Modulated Inner Rotor Volume (MIRV) 90 is generally triangular in shape, each volume formed by the inner surfaces 24 of adjacent pivoting blades 20 extending from their common pivot 50 to their respective transfer slots 22 and the outer surface 80 of the annular power sleeves 66, 68. The volumes 90 vary as the rotor 18 rotates. The volumes 90 are forty five degrees out of phase with the outer combustion chambers 92, and make an integrated efficient annular pump or ventilating device, displacing a total of 8 times its volume in every rotation. Ventilating ports 102 are located in the lateral side covers 16 near the external surface of the annular track 28 in the vicinity of the wheel-bearings 26 when the rotor is in its maximum diamond length configuration. The geometry permits pulsing ventilation if all the ventilating ports 102 in the lateral side covers 16 are open, or two different one-way ventilation circuits in the same or opposed axial direction, if proper ventilation ports 102 are selected on both sides of the engine. When the side covers 16 have only a crossed-symmetrical-through-center set of ventilation ports 102, as shown in FIG. 1, entrances occur only from one engine side and exits to the other, while consecutive ports on the same side covers would make the entrances and exits on the same engine side. Using a radial check valve 40 across and through the pivoting blade body could allow transfer to-and-from the chambers with the central area, which may be of interest for example in the Quasiturbine-Stirling-Steam engine, compressor, or enhanced mixture intake by the gas centrifuge force through the central engine area. The Modulated Inner Rotor Volumes (MIRV) 90 forms a well-integrated annular pump and can be used as such in many applications, or to ventilate and cool the rotor in engine mode. They can also form a second stage low flow high-pressure device when in compressor mode, or to provide the pressure fluctuation required by a standard carburetor diaphragm fuel pump. Furthermore, a very high-pressure can be obtained from the scissor-pivoting-blade effect at the joint 50 when the guiding male finger 112 moves in and out of position. Similarly, other piston-like devices can be incorporated in this scissor action to produce high-pressure pumping effect like a Diesel fuel pump to drive the fuel injectors. Ultimately, the Modulated Inner Rotor Volumes (MIRV) 90 can also be made to work as an Inward Rotor Engine Quasiturbine (IREQ), while the Quasiturbine outward rotor is used as a compressor, a pump, or for other applications.

A new Quasiturbine Internal Combustion QTIC-cycle mode is made possible, combining Otto, Diesel and eventually photo-detonation mode. Otto engine cycle intakes and compresses a sub-atmospheric manifold pressure air-mixture for uniform combustion, while the Diesel engine cycle always intakes and compresses atmospheric pressure air-only, which gives a non-uniform injected fuel combustion. Due to the possibility of a shorter confinement time and a faster linear ramp compression-pressure raising-falling slope, the new Quasiturbine Internal Combustion QTIC-cycle mode consists of intaking, at atmospheric pressure, a continuous air-fuel mixture for uniform combustion, thereby combining Otto and Diesel modes. This mode is not possible with a piston engine, because the sine-wave shape of the maximum compression ratio poorly defines the top dead center by making an unnecessary long confinement time, consequently requiring a reliable external trigger source such as a sparkplug or a fuel injector. The Quasiturbine Internal Combustion QTIC-cycle can work at a moderate compression ratio with a sparkplug 44, or without it at a very high compression ratio for almost any fuel, the photo-detonation being auto synchronized by its very short linear ramp pressure pulse tip. A regular piston cannot stand photo-detonation because it keeps the mixture confined too long, and because the relatively small piston mass required by the severe accelerations at both strokes ends prevent making a stronger piston. The upward piston momentum aggravates the effect of knocking, while the homo-kinetic rotation of the Quasiturbine allows for relatively more massive pivoting blades making the passage at top dead center almost without momentum change. This QTIC-cycle mode only requires a non-synchronized fuel pulverization and vaporization in the Quasiturbine atmospheric intake continuous airflow, suppressing the need of conventional vacuum carburetor or synchronized fuel injector and sparkplug timing in photo-detonation mode, and allows for a much higher RPM than the conventional mode due to continuous intake flow without valve obstruction and faster photo-detonation chemistry combustion. The photo-detonation being a fast radiative volumetric combustion, it leaves much less unburnt hydrocarbon that has plenty of extra time left for completing the combustion. Furthermore, due to the possibility of shorter confinement time, the combustion chemistry does not have enough time-pressure to produce the $NO_x$ before expansion begins, producing a cleaner exhaust, including with the hot hydrogen combustion in presence of nitrogen. Because of the zero dead time, the Quasiturbine can provide continuous combustion by using an ignition transfer slot-cavity 88 cut into the internal contoured housing wall 14 for flame transfer from one chamber to the following one. This ignition flame transfer slot-cavity 88 also allows the injection of high-pressure hot burning gas into the following, ready-to-fire, chamber, producing a dynamically enhanced compression ratio, since near top dead center, a little volume change in the combustion chamber makes a large change in the compression ratio. For better multi-fuel capability, a compression ratio tuner 42 made of a simple small threaded piston in a tube is used in place of the sparkplug 44, and allows compression ratio fine-tuning as needed, and can be dynamically feedback controlled.

The Quasiturbine can be generally used as an engine, compressor or pump, and sometimes in a dual mode. To name a few applications, it is suitable for small or very large units in steam, pneumatic and hydraulic mode (including use in reversible waterfall hydroelectric stations), and in a combined engine-turbo-pump mode where one intake port and its corresponding exhaust port are used in a compressed fluid energy converter engine mode while the other intake and exhaust ports can be used as a positive or vacuum pump or compressor. The Quasiturbine can be used as an internal combustion engine in Otto or Diesel in two or four stroke mode. The Quasiturbine engines in photo-detonation mode with a high compression ratio (20 to 30:1) are particularly suitable for natural gas and other fuels that are hard to burn to environmental standards like jet fuel or low specific energy gases, in which case the fuel is simply mixed to the atmospheric pressure intake without any synchronization means. It can be further used in a continuous combustion mode with a flame transfer cavity 88 at the forward contour seal 60 near top dead center. It can be used in a Quasiturbine-Stirling-Steam rotary engine mode with pressurized gas or phase change liquid-steam, with the hot poles alternating with the cold poles, a device which is reversible and can be used as a heat pump. Most of the previous engine modes allow operation without a sparkplug (no electromagnetic field), with a plastic or ceramic engine bloc and with low noise level, all qualities most suitable for low signature stealth military operation. Furthermore, those previous modes permit very energy efficient operation and more complete internal combustion than conventional piston engines to meet the most severe environmental standards of the future. The Quasiturbine can also be used as an engine to drive a turbo-jet engine-compressor, allowing the suppression of the hot-power-turbine and its associated limitations in temperature, efficiency and speed. In the opened or closed Brayton mode, a cold Quasiturbine can act as compressor while a second hot Quasiturbine possibly on the same shaft can produce power in a pneumatic mode, in order to make a jet engine without jet (no gas kinetic energy intermediary transformation is involved, which makes it almost insensitive to dust particles). The second hot Quasiturbine can be suppressed and the system used as a high flow hot gas generator. It can be used in a vacuum engine mode, including with imploding Brown gas. Many applications do not require the Quasiturbine to have its own power disk 84 and/or shaft 86, since the shaft attachment differential washers 82 can be fixed directly on the accessory shaft (of a generator, a gearbox, a differential shaft, by way of example) and the Quasiturbine simply slides over the accessory shaft to mount it without any need for shaft alignment. The empty center of the Quasiturbine is particularly suitable to locate a propeller therein and makes a self-integrated marine jet propulsion system, or a liquid or gas turbine-like pump, where the complete engine can be submerged. This empty center is also suitable to locate electrical components for a lightweight compact electrical generator or electrical motor for a compressor or pump. The fast acceleration resulting from the absence of the flywheel and the high engine specific power density allows the use of the engine in strategic applications, as in heavy load soft landing parachuting. Improved engine intake characteristics allow the Quasiturbine to run better than piston engines in rarefied-air as in high altitude airplane operation. Its low sensitivity to photo-detonation and potentially oil-free operation make it most suitable for hydrogen fuel operation, including with lateral intake stratification and natural atmospheric aspiration. Since the Quasiturbine has no oil pan and does not require gravity oil collection, it can run in all possible orientations, and even out in space in micro-gravity. The Quasiturbine has a favorable geometry where lubricant is not needed for cooling, where no internal parallax forces exist, and where no seal is under internal stress and subject to hydrogen fragilisation. Several Quasiturbines in different modes can be stacked side-by-side on a single common power shaft through simple ratchet coupling for torque addition. The Quasiturbine can also be used as a general replacement engine, compressor or pump in most present and future applications, and with most principles or processes where modulated volume is required.

The internal contoured housing wall 14 is derivate from an empirical generating equation of the variable diamond geometry of the rotor for all rotation angles. The internal contoured housing wall 14 is not unique but part of a family of curves, and selection must be done according to an engine efficiency criteria. Before calculating the Saint-Hilaire confinement profile for the internal contoured housing wall 14, one must calculate the blade pivots joint 50 profile curve. Since this profile does require only symmetry across the central engine axis, any initial arbitrary pivot movement from 0 to 45 degrees (or ⅛ of a turn in a non-orthogonal axis situation) does determine the complete pivot point curve. This empirical 0 to 45 degree curve must meet three constraints: be parallel to the y-axis at 0 degree angle x-crossing; be matching at the diamond-square configuration corners; and furthermore, the slope at those corners must be continuous. Assuming Rx the pivot profile radius on the x-axis, and Ry the pivot profile radius on y-axis, and R45 the pivot profile radius at 45 degrees where the rotor is in square configuration, the modified M(θ) linear radius variation between 0 and 45 degree could be empirically of the form (pivot profile, not the actual internal contoured housing wall 14):

$$R(\theta)=(Rx-(Rx-R45)\theta/45)M(\theta)$$

Where the modifying parametric function M(θ) has the form:

$$M(\theta)=1+A\sin(4\theta(1-P\sin(4\theta)))$$

The pivot profile in the 45 (R45) to 90 (Ry) degrees interval is simply given by the Pythagoras diamond-lozenge formula. The two constants A and P provide a parametric adjustment of the radius variation where +/− A controls the amplitude and affects mostly the axis areas, and +/−P controls the angular maximum variation position and affects the wideness of the overlap zone near 45 degree from the x−axis. This empirical representation has been found adequate to explore most of the family of pivot profiles of interest, including the very high eccentricities leading to two lobes confinement profiles. The internal contoured housing wall 14 presented in FIGS. 1 and 2 is obtained from the pivot concave eccentricity limit profile curve, enlarge by the rubbing pad 54 radius all around. This enlargement must be perpendicular to the local pivot profile tangency at all angles. Furthermore, in order for the engine to be described by the most efficient Pressure-Volume PV diagram, the final expansion volume of the engine chamber must be equal to the volume generated by the variable surface of tangential push, which is proportional to the radius difference of two successive contour seal 60 positions during rotation. These criteria permit to select a subfamily for the optimum engine mode efficient internal contoured housing wall 14. A good way to fine-tune the value of the A and P parameters is to control the smoothness of the calculated confinement wall radius of curvature. This radius of curvature continuity can be easily achieved for the no-lobe limit case with both A and P positive and less than 0.09, but it is not progressive here as other profiles previously reported in U.S. Pat. No. 6,164,263. Great care must be taken not to be mislead by the appearance of this internal contoured housing wall 14 which is far more complex than an ellipse. For the example presented here, where the pivot to pivot length is L=3.5" and the pivot rubbing pad 47 diameter is D=0.5", the internal contoured housing wall 14 radius of curvature in one quadrant goes from 2.67" near the x-axis, down to 2.05" near 33 degrees, up to 4.50" near 65 degree, and finally down again to 2.60" near the y-axis, which indicates a relative flat zone between 33 and 65 degree. This flat zone internal contoured housing wall 14 structure is not as obvious in U.S. Pat. No. 6,164,263, but demands a high precision calculation method. An additional interesting exploratory profile parameter is the exponent of M(θ) in the 0.3 to 3 range, which is not detailed here. Notice that the profile complexity depends greatly on the selected pivoting blades diamond eccentricity (here Ry/Rx=0.8).

The Saint-Hilaire internal contoured housing wall 14 presented on the FIGURES uses nearly the same rotor pivot eccentricity (Ry/Rx=0.8) as the Quasiturbine in patent U.S. Pat. No. 6,164,263. One should notice that increasing the radius of the joint-rubbing pad centered on each pivot tends to attenuate the high curvature in the corners of the Saint-Hilaire "skating rink" confinement profile, but contributes to increase the maximum torque, with no net penalty on the specific power and weight density of the Quasiturbine, without however achieving as stiff a linear ramp pressure that the rolling carriages design permits. If the rotor can be made of strong material like steel, the pivot rubbing pad 54 radii can be made relatively small and lead to the selected internal contoured housing wall 14 shown, which is a near optimum Quasiturbine specific power and weight density. It is hard to notice by looking at the internal contoured housing wall 14 that the radius of curvature fluctuates along the profile. Inside the rotor 18, one notices a triangular shaped-like chamber making a Modulated Inner Rotor Volume (MIRV) 90 in-between the inner surface 24 of the pivoting blades 20 and the outer surface 80 of the annular power sleeves 66, 68 at every rotor pivot 50 location. Changing the shape of the rotor 18 for the purpose of producing internal central volume variation for an annular pumping application would need no rotor rotation, but only a steady on-site "oscillating rotor deformation", possibly driven by a rotating external confinement profile, or by a x- or y-axes movement. The rotor deformation could also be driven from an alternating pressurization of these Modulated Inner Rotor Volumes (MIRV) 90, such as to make an Internal Rotor. Engine Quasiturbine (IREQ). This calculation method does not require profile symmetry through x- and y-axes, but only through the central point, which means that the axes may not be orthogonal with this same calculation method, in which case the confinement profile could be, asymmetrical, producing an interesting Quasiturbine with different intake and exhaust volume characteristics, and with only minor rotor change.

We claim:

1. A rotary apparatus producing mechanical energy from hydraulic, steam, and pneumatic pressurized fluid flow, and from Stirling cycle, Brayton cycle, Otto and Diesel internal combustion cycles and to pump, vacuum and compress, generally referred to as a Quasiturbine, and comprising:

a stator casing having an internal contoured housing wall, including two lateral side covers;

pivoting blades consecutively pivoted one to the other at their ends, and pivot axes being parallel; wherein each of said pivoting blades carrying an inwardly directed power transfer slot;

an assembly of said pivoting blades and joints forming a X, Y, θ variable-shape rotor rolling inside said internal contoured housing wall about a central axis;

a method of calculating a family profile of curves for said internal contoured housing wall, and selecting criteria to meet the pressure-volume engine PV diagram;

each of said lateral side covers carrying an annular track on an inner surface;

a set of contour seals in contact with said internal contoured housing wall, and a system of lateral seals in contact with said lateral side covers;

variable volume chambers, each of said variable volume chambers limited by two successive contour seals, and extending along the inner surface of the internal contoured housing wall, and the outer surface of said pivoting blades;

each of said pivoting blades carrying a combustion chamber cavity;

a set of ports in said casing for intakes and exhausts;

a set of ports in said lateral side covers for intakes and exhausts;

a set of ports through said pivoting blades, connecting said variable volume chamber to the central area;

an ignition flame transfer slot-cavity;

a compression ratio tuner;

a set of clutch centrifuge weights inside a rotor;

a set of annular power sleeves located inside said rotor;

a modulated Inner Rotor Volumes (MIRV) within said rotor;

a set of differential washers linking said annular power sleeves to a power disk and a power shaft;

wherein all consecutive compressions housing areas are occurring repetitively in the same housing areas, and all consecutive expansions are also occurring repetitively at different intermediate housing areas;

wherein the two compression housing areas are opposed, and the two opposed expansion housing areas;

wherein each successive compression stroke and expansion stroke start and end simultaneously;

wherein the distance between two consecutive contour seals stays almost constant during a revolution of said rotor, wherein the contour seals stay almost perpendicular to said internal contoured housing wall at all time;

wherein said differential washers prevents the wheel-bearings axes rotational harmonic to reach said power shaft;

wherein said rotor and said differential washers linking centers of mass are immobile during rotation;

wherein said variable volume chambers are asymmetric from mid-value, and the pressure pulse is short and increases and decreases linearly near the top dead center;

wherein a Quasiturbine Internal Combustion cycle (QTIC) results from said pressure pulse characteristics;

wherein said Modulated Inner Rotor Volume (MIRV) is 45 degrees out of phase with outward rotor chambers; and wherein said Modulated Inner Rotor Volume (MIRV) is alternately pressurized to make an Inward Rotor Engine Quasiturbine IREQ), driving said rotor from the interior;

wherein the direction of rotation is reversed, reversing the direction of the flow.

2. The rotary apparatus as defined in claim 1, wherein said internal contoured housing wall is a rounded corner parallelepiped shape, with four areas of maximum curvature and four intermediate areas of minimum curvature, and wherein the complexity of the internal contoured housing wall makes the radius of curvature to slightly fluctuate within one single quadrant.

3. The rotary apparatus as defined in claim 1, wherein to permit higher eccentricity of said rotor, the calculated internal contoured housing wall is lobed shaped, with six areas of maximum curvature and six intermediate areas of minimum curvature.

4. The rotary apparatus as defined in claim 1, wherein the mathematical contour profile of the said internal contoured housing wall is one of a family of curves requiring only symmetry about the center of the internal contoured housing wall and not through the x- or y-axis, and the method for calculating the said internal contoured housing wall profile, including large eccentricity lobed solutions and limited cases, referred the following calculation steps:

selecting a diamond-shaped rotor eccentricity which imposes and defines at design the x- and y-axes blade pivot profile coordinates, while the square said rotor configuration defines the 45 degrees pivot profile coordinates;

calculating a set of blade pivots profile;

linearly assuming empirical blade pivots profile radius in the 0–45 degrees interval, and modulating said empirical blade pivots profiles radius based on at least a two-parameters function which does not change the 0 and 90 degree area tangentiality;

performing oblique lozenge mapping; and a simple Pythagoras Diamond-diamond mapping of the 0–45 degrees interval, with slope continuity in the 45 degrees area, in the case of the perpendicular x- and y-axes of the 45–90 degrees interval;

obtaining a corresponding set of said internal contoured housing wall by enlarging said blade pivots profile by one pivot radius all around;

wherein from the set of said internal contoured housing walls, the selection of an optimum engine application internal contoured housing wall is done, wherein the final said chamber expansion volume equals the volume generated by the movement of the tangential surface of push, in order to meet the pressure-volume standard engine PV diagram; and wherein the method applies for all values, including of positive values, negative values and null values of the eccentricity, the pivot diameters, and the x- and y-arbitrary axes angle.

5. The rotary apparatus as defined in claim 1, wherein the lateral side covers have:

multiple notches on the periphery for thermal fins;

an annular track on the inner surface for the pivoting blade wheel-bearings, the tracks not necessarily circular except if the pivoting blade wheel-bearings are located on the axis of two successive pivots;

a bearing holder on the engine axis for the power shaft;

a large aperture on one lateral side cover on the engine axis, permitting the power disk and the power shaft to slide in-and-out the casing without dismantling the engine;

a bearing-cap fitting the large aperture, and holding a bearing and the power shaft; and volume modulator ports outside the periphery of the annular track, for the Modulated Inner Rotor Volumes (MIRV).

6. The rotary apparatus as defined in claim 1, wherein the pivoting blade comprises:

an outward surface shaped to insure free rotation of the rotor within the internal contoured housing wall for all angles of rotation;

an outward surface being cave-cut to enlarge the combustion chamber when required;

a check-valve port made radially through said pivoting blade, and linking the said combustion chambers to the central engine area;

said check-valve port allowing chamber intake enhancement by centrifuge force;

a power transfer slot extending inwardly toward the central rotor area;

a receptacle space within the said Modulated Inner Rotor Volumes (MIRV), on both side of said transfer slot, to locate the clutch centrifuge weights; and an axial strong pivoting joint at said pivoting blades ends.

7. The rotary apparatus as defined in claim 1, wherein said ports are radial housing ports for a spark plug, a compression ratio tuner, and for intake and exhaust ports located near where the contour seals stand at top dead center.

8. The rotary apparatus as defined in claim 1, wherein said ports are lateral side cover ports for a spark plug, a compression ratio tuner, and for intake and exhaust ports located on the pivoting blade pivot path, near the blade pivot positions when at top dead center.

9. The rotary apparatus as defined in claim 1, wherein said intake and exhaust ports comprise:

several removable intake and exhaust plugs, which are used to convert the two parallel compression and expansion circuits into a sole serial circuit;

two quasi-independent circuits used in parallel with all plugs removed for operation as a two stroke rotary internal combustion engine, a fluid energy converter, a compressor, a vacuum pump and a flow meter; and two quasi-independent circuits used in serial by plugging intermediate ports, to make a four stroke internal combustion rotary engine.

10. The rotary apparatus as defined in claim 1, wherein said intake and exhaust ports have different angular locations for different applications, and wherein:

symmetrically opposed said ports with respect to engine center are used for fluid energy converter, compressor and two strokes engine applications;

said symmetrically opposed ports are slightly moved toward the high-pressure zone, to take advantage of the pivoting blade port obstruction during port-seal crossing, preventing momentarily free intake-to-exhaust flow;

said intake port for internal combustion engine is an arc-shaped like opening in an angular suction zone in relation to the forward contour seal, and extending further to account for fluid flow time delay;

said check-valve port made radially through said pivoting blade, permits chamber central intake enhancement by the centrifuge force;

said exhaust port for internal combustion engine is shaped as an elongated angular opening, extending to account for fluid flow time delay and inertial exhausting; and said sparkplug and compression ratio tuner are located in the high-pressure zone, anywhere in between the pivoting blade contour seals when at top dead center horizontal position, extending further to account for fluid flow time delay.

11. The rotary apparatus as defined in claim 1, wherein a pivoting blade joint comprises:

a male and a female part at the respective ends of said pivoting blade;

two female parts at both ends of the same said pivoting blades, while said male parts are at both ends of the two complementary pivoting blades of said rotor;

the male part made cylindrical with two different radiuses of curvature, having an underneath holding finger so that four and more pivoting blades can be firmly assembled together;

the male part acting as a rubbing pad against the internal contoured housing wall to guide the rotor deformation into proper diamond shape, having provision for hard metal insert to allow for material of plastic, ceramic, glass and others;

the female part having an arm extension also holding two different radiuses of curvature;

an in-joint seal within a groove located in and along said female part; and the joint having a provision for an in-joint bearing, linking friction-free the cylindrical male part to the female part.

12. The rotary apparatus as defined in claim 1, wherein said transfer slot comprises:

a pivoting blade wheel-bearings shaft parallel to the engine axis, near mid-way between said blade pivots;

a cylindrical wheel-bearings shaft holder fitting tightly with the wheel-bearings shaft and the transfer slot;

the extremities of said wheel-bearings shaft each carrying one wheel-bearings rolling on said lateral side cover annular track; and an attachment space on said wheel-bearings shaft for one of the said annular power sleeves bearing ears, allowing driving of the central power disk and power shaft.

13. The rotary apparatus as defined in claim 1, having a set of contour seals each located in a linear groove extending along the engine axis within said pivoting blade male joint and comprising:

a gate type seal being a back spring-loaded sliding;

a gate type seal being a back spring-loaded sliding in fit contact simultaneously with the internal contoured housing contour wall and the lateral side covers; and a contour seal damper made of a rubber band lying in the bottom of the groove on which said contour seal and spring are sited.

14. The rotary apparatus as defined in claim 1, having a system of lateral seals carried by said pivoting blades and comprising:

a curved groove and a curved seal in contact with said lateral side covers; and a moon-like shaped groove and pellet seal on each side of said male joint.

15. The rotary apparatus as defined in claim 1, wherein said lateral seals include:

a moon-like shaped groove and pellet seal on each side of said male joint; and an almost elliptic pivots path groove and static back-pressured ring in each side cover, which by design is in permanent contact with the rotor.

16. The rotary apparatus as defined in claim 1, wherein a lubrication is suppressed, and comprising:

a favorable geometry where lubricant is not needed for cooling;

a favorable geometry where no internal parallax forces exist;

a favorable geometry where no seal is under internal stress, and subject to hydrogen fragilisation; and said contour seals and lateral seals system made of very hard material for operation without lubricant.

17. The rotary apparatus as defined in claim 1, wherein said annular power sleeves comprises:

an empty annular ring concentric with the engine axis, with an interior receptacle for said differential washers linking the power disk;

two opposed small bearing-rings, each linked to a pivoting blade wheel-bearings axis;

multiple grooves on the inner surface of said empty annular ring, for tangential torque transfer to said differential washers;

a set of seals carried by said empty annular ring, to leak proof the inner area from the outer area;

wherein the two said annular power sleeves are inserted co-linearly 90 degrees apart within the Quasiturbine, each one making a relative back and forth rotation not at constant angular speed; and wherein the load-pressure on two opposed said pivoting blades when in the fluid energy converter mode is canceled out by the annular power sleeves, generally suppressing the need for the said wheel-bearings and the annular track.

18. The rotary apparatus as defined in claim 1, wherein said clutch centrifuge weights comprise:

a plurality of said clutch centrifuge weights located in-between said pivoting blade and the annular power sleeves;

said clutch centrifuge weights pivoting around the closest wheel-bearings axes;

a plurality of friction clutch pads located on the outer surface of the annular power sleeves, where the rotation is not at constant angular speed;

a plurality of friction clutch pads located on the inside surfaces of the said annular power sleeves, where the rotation is not at constant angular speed;

a plurality of friction clutch pads located on the surface of said power disk, where the rotation is at constant angular speed;

a plurality of friction clutch pads located outside the Quasiturbine engine, but driven by the inside said clutch centrifuge weights; and a clutch pad-locking mechanism to permit to crank the engine by the said power shaft for starting.

19. The rotary apparatus as defined in claim 1, wherein said Modulated Inner Rotor Volume (MIRV) comprises:

a triangular shaped-like chamber defined by the inward joint of two successive said pivoting blades and the outer surface of the annular power sleeves, and extending from one respective pivoting blade wheel-bearings axis to the other;

wherein the Modulated Inner Rotor Volumes (MIRV) are 45 degrees out of phase with said outward rotor chambers;

wherein said triangular shaped-like chamber has a minimum volume at open diamond corner angles and a maximum volume at closed angles;

wherein the rotation of said rotor expels the gas-liquid enclosed in the maximum volume, and intakes similar content from the minimum volume configuration;

wherein said Modulated Inner Rotor Volumes (MIRV) act as a compressor-ventilator, and as a second stage low-flow high-pressure compressor mode;

wherein said Modulated Inner Rotor Volumes (MIRV) ventilate the rotor inside area through two independent top and bottom circuits by either pulsing, parallel and opposite flow directions;

wherein the said Modulated Inner Rotor Volumes (MIRV) circle air-liquid coolant through the engine block and in the rotor central area, providing an integral cooling active circuit;

wherein said Modulated Inner Rotor Volumes (MIRV) provide the pressure fluctuation required to operate a standard carburetor fuel diaphragm pump;

wherein said Modulated Inner Rotor Volumes (MIRV) work in both directions of rotation, upon reversing the direction of the flow; and wherein very high-pressure is obtained from the pivoting blades scissor-effect, to drive a Diesel fuel pump and other device.

20. The rotary apparatus as defined in claim 1, wherein said Modulated Inner Rotor Volumes (MIRV) work as a compressor, a pump and an oscillating engine, without rotation but simply by successive oscillating deformation of said rotor diamond-shaped, by using an alternating piston, external fluid pressure or otherwise.

21. The rotary apparatus as defined in claim 1, wherein said pivoting blade Modulated Inner Rotor Volumes (MIRV) act as an Inward Rotor Engine Quasiturbine (IREQ), and comprises:

a triangular shaped-like chamber defined by the inward joint of two successive said pivoting blades and the outward surface of the annular power sleeves, and extending from one respective pivoting blade wheel-bearings axes to the other;

wherein the said triangular shaped-like chamber has a minimum volume at open diamond corner angles, and maximum volume at closed angles;

wherein a pressure in the minimum volume configuration of said chamber provokes the said rotor to rotate 90 degrees toward a maximum volume configuration;

wherein successive said triangular shaped-like chamber pressurizations continuously drive said rotor in an engine mode; and wherein the said Inward Rotor Engine Quasiturbine (IREQ) mode leaves the rotor outward areas free for compressor, pump and other uses.

22. The rotary apparatus as defined in claim 1, wherein said differential washers linking comprises:

a large diameter power disk concentric to, and carrying the power shaft, and having a plurality of radially extending pins receptacles;

a set of differential washers carrying two washer-pins inserted into said radially extending pins;

said power disk external surface shape as part of a sphere of same diameter and the differential washer shaped accordingly to permit perfect sitting on the power disk spherical surface;

said two washer-pins of the differential washers fitting into said annular power sleeves interior grooves and steps;

a play in-between said power disk external diameter and said annular power sleeves internal diameter to permit said differential washers to rotate slightly around said radially extending pins;

a curvature of the said power disk perimeter surface along the axial direction, to give room for the rotation of the said differential washers;

a design permitting the sliding in-and-out of said differential washers linking through one of the Quasiturbine said lateral side covers central aperture without dismantling the engine; and wherein said differential washers linking prevents said: pivoting blades rotational harmonic to reach the said power disk and power shaft.

23. The rotary apparatus as defined in claim 1, wherein said central shaft comprises:

a central shaft collinear with the central housing axis, crossing the two lateral side covers and supported by bearings in at least one of the lateral side covers;

a central shaft coupling mechanism composed of said power disk and said differential washers linking;

wherein the shaft coupling mechanism is made as a sliding plug-in unit, easily slide in-and-out without dismantling the engine;

wherein said differential washers linking mechanism removes the RPM harmonic modulation on the shaft;

wherein the shaft gives full power takeoff at both of its ends;

wherein said power disk and power shaft are not mandatory for engine operation and are removed;

wherein the central shaft can be a very large diameter thin wall tube shaft carrying an axial thrust bearing at least at one end, and an engine crank starting device at either ends, enclosing accessories like propellers screw, electrical components, generator, gearbox shaft and similar; and wherein several Quasiturbines in different modes, are stacked side-by-side on a single common said power shaft through simple ratchet coupling for torque addition.

24. The rotary apparatus as defined in claim 1, wherein in engine mode, said ignition flame transfer slot-cavity comprises:

a cut into the internal contoured housing wall, located nearby where the forward contour seal stands at maximum chamber pressure, to allow a flame transfer from one said chamber to the next following chamber, and to permit continuous combustion; and wherein said ignition flame transfer slot-cavity allows the injection of high-pressure hot burning gas into the next ready to fire chamber, producing a dynamically enhanced compression ratio.

25. The rotary apparatus as defined in claim 1, wherein in engine mode, the high-tech fuel gases and hydrogen fuel capability comprise:

multi facing said intake ports located axially one each side of the engine, and easily accessible to permit independent and stratified admission of fuel and air;

multi side-by-side said intake ports located radially on the internal contoured housing wall, and easily accessible to permit independent and stratified admission of fuel and air;

said pivoting blades, wheel-bearings and annular tracks made very strong; and an intake chamber area kept cold, to permit direct high-tech fuel gas and hydrogen backfire-proof intake and engine photo-detonation mode if required.

26. The rotary apparatus as defined in claim 1, wherein said Quasiturbine Internal Combustion QTIC-cycle comprises:

a fast and linear pressure-compression raising-falling Quasiturbine characteristic near top dead center;

a continuous atmospheric air pressure intake without butterfly valve restriction;

a fuel vaporized, sprayed, and mixed directly into said continuous atmospheric air pressure intake without synchronization means;

a compression of the said fuel mixture to standard pressure level, and a uniform combustion triggered by a sparkplug;

a said compression ratio tuner made of a small adjustable threaded piston, to replace the sparkplug at very high compression ratio;

a compression of said fuel mixture to the Diesel-like pressure level by the short fast raising-falling Quasiturbine pressure pulse, and a uniform combustion driven by the adiabatic high temperature and radiation conditions;

at very high-pressure, a photo-detonation engine mode made possible, where no sparkplug or otherwise synchronization mean is needed;

a volume variation near top dead center without said pivoting blade mass momentum transfer, to well resist the photo-detonation knocking; and a heavy construction of said rotor pivoting blades for inertial smooth-out of the photo-detonation knocking.

27. The rotary apparatus as defined in claim 1, wherein thermalization comprises:

said cylindrical shape male joint of the pivoting blade being in direct mechanical contact with said internal contoured housing wall, thereby increasing the combustion chamber walls thermalization, heat transportation and dissipation;

at least one of the two lateral side covers having a large central hole exposing the pivoting blades central area of the rotor, thus eliminating the so called internal engine parts, and so improving the cooling and reducing the need for lubricant thermal role; and a forced liquid and gas ventilation by said Modulated Inner Rotor Volumes (MIRV) in the area between said pivoting blades and said annular power sleeves.

* * * * *